United States Patent [19]

McCarthy, Jr.

[11] 4,291,489

[45] Sep. 29, 1981

[54] PUSH TOY

[75] Inventor: Thomas C. McCarthy, Jr., North Providence, R.I.

[73] Assignee: Hasbro Industries, Inc., Pawtucket, R.I.

[21] Appl. No.: 162,381

[22] Filed: Jun. 23, 1980

[51] Int. Cl.³ ..... A63H 11/10

[52] U.S. Cl. ..... 46/205; 46/107

[58] Field of Search ..... 46/205, 204, 106, 107, 46/99, 114, 220

[56] References Cited

U.S. PATENT DOCUMENTS

| | | | |
|---|---|---|---|
| 1,240,434 | 9/1917 | Gehrig | 46/114 |
| 2,409,839 | 10/1946 | Criner | 46/205 X |
| 2,509,805 | 5/1950 | Briggs | 46/205 X |
| 2,800,745 | 7/1957 | Zalkind | 46/205 X |
| 2,879,625 | 3/1959 | Bolger | 46/107 |
| 2,900,758 | 8/1959 | Glass | 46/107 X |

*Primary Examiner*—Gene Mancene

*Assistant Examiner*—Mickey Yu

*Attorney, Agent, or Firm*—Salter & Michaelson

[57] ABSTRACT

A wheeled push toy including a housing and a push rod. A first action element is adapted to move up and down in a generally continuous fashion with respect to the housing while a second action element is adapted to be intermittently propelled up the push rod a short distance and fall back by gravity. The action of the above described elements is controlled by the movement of the supporting wheels of the toy and preferably in a fashion such that the intermittent movement of the second action element is produced only upon forwardly pushing the toy in contrast to rearwardly pulling such.

6 Claims, 7 Drawing Figures 10
24
26
30
28
2
20
86
22
16
14
12
2

3
28
62
54
52
56
12
20
94
68
100
58
66
64
60
46
36
40
46
34
38
48
18
32
44
96
92
50
42
16
16
3

12
62
28
54
78
7
94
86
7
22
76
100
112
64
102
10
104
50
98
108
92
106
96
110
16
18
100

PUSH TOY

BACKGROUND AND SUMMARY OF THE INVENTION

This invention relates to a child's toy and more particularly to that type toy adapted to be pushed along a supporting surface. Such general type of toy device is known and may include an action element which is separately moveable from the main housing of the device so as to add further interest to the child using such. Such separate action element may be controlled by the rotation of the device's supporting wheels as by cranks and the like and representative structures of such a device are shown in the following U.S. Pat. No. 2,404,186 to Mariani issued July 16, 1946; No. 2,409,839 to Criner issued Oct. 22, 1946; No. 2,879,625 Bolger issued Mar. 31, 1959; and No. 3,570,174 to Lemelson issued Mar. 16, 1971.

It is a primary object of the present invention to provide a device of the aforementioned type which increases the attention of the child and accordingly enhances the play value of the toy.

A further object of the invention is the provision of a toy of the above-described type which includes two distinct action elements, one of which assumes a continuous movement while the other moves in an intermittent nature so as to provide a reoccuring action event to the child playing with the device.

A still further object of the invention is the provision of a toy of the immediately above discussed type wherein one of the action elements and preferably that operating on an intermittent cycle functions in one directional movement of the toy only, i.e., when the toy is pushed as contrasted to when the toy is pulled.

These and other objects of the present invention are accomplished by a push toy comprising a housing, a generally upright push rod connected thereto, said housing including an axle for supporting wheel means in turn adapted to rotate in contact with a supporting surface as said toy is moved thereacross by said push rod, a first action element supported by said housing and adapted for reciprocal movement with respect thereto, first activation means associated with said axle for generally continuous moving said first element during movement of said toy and second activation means associated with said axle for intermittently moving a second element during movement of said toy.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
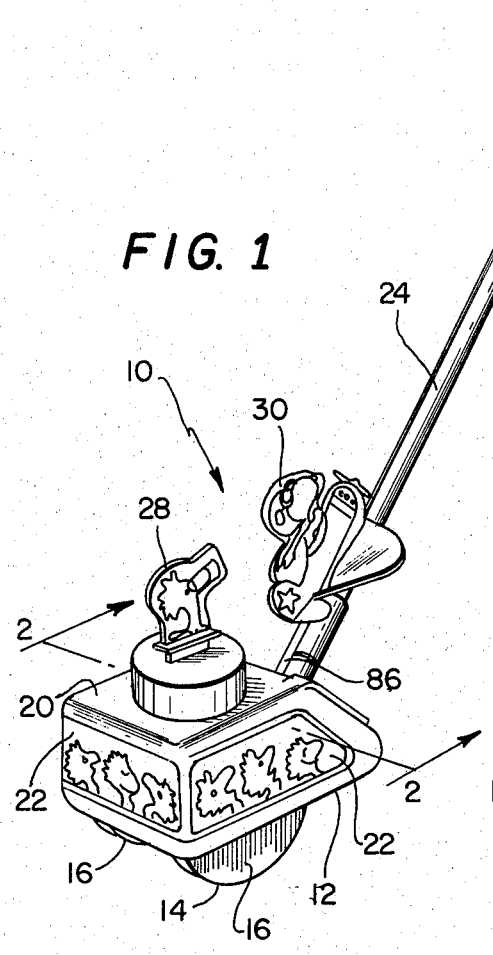
FIG. 1 is an overall perspective view of the device of the present invention.

Referring to the drawings and more particularly FIG. 1 thereof, the overall structure of the push toy 10 of the present invention is shown. Such includes a decorative and functional housing 12 supported by wheel means 14 in turn comprising a pair of spaced wheels 16 supported by an axle 18. The housing includes an upper surface or panel 20 and a plurality of side panels 22 which may be suitably decorated. A push rod 24 which terminates at its upper end in a handle element 26 is disposed at the rear of the housing in such a position to facilitate pushing of the toy 10 in a forward direction, that is, from right to left as shown in the drawings. A first action element 28 is adapted to move up and down simultaneously with movement of the toy in a generally continuous fashion as the toy is propelled along a suitable supporting surface and an independently operable second action element 30 is slidably mounted on the push rod 24 and adapted for intermittent operation. Both the first and second action elements 28 and 30 respectively may take any suitable form other than those shown in the drawings which respectively simulate a bird and an airplane piloted by a cartoon character.

Turning now to the remaining figures of the drawings, it may be seen that axle 18 is suitably journaled at opposite ends thereof in a frame member 32 which in turn forms the lower portion of the housing 12. The wheels 16 are disposed on bearing caps 34 which in turn are mounted on the axle 18. A cam and pinion member 36 of an overall elongated configuration is supported by the axle 18 and fixedly connected to the wheels 16. In other words, the pinion cam assembly 36 moves as a unit with the rotation of the wheels 16 about the axle 18. The pinion and cam assembly 36 may be molded integrally or be of two-piece construction as shown, that is, including a pinion member 38 and a cam member 40 each adapted to contact each other centrally of the housing 12 and having at their respective opposite ends some suitable means by which they are rotationally interconnected with the wheels 16. Such means may include a radiating blade or blades 42 and 44 keyed into recessed hubs 46 formed in the wheel 16; the essential feature being that rotational motion caused by the wheel 16 moving across a supporting surface correspondingly causes a rotational movement in the cam and pinion assembly 36. The cam member 40 includes a body 48 from which an eccentric cam 50 radially extends.

Figure 2:
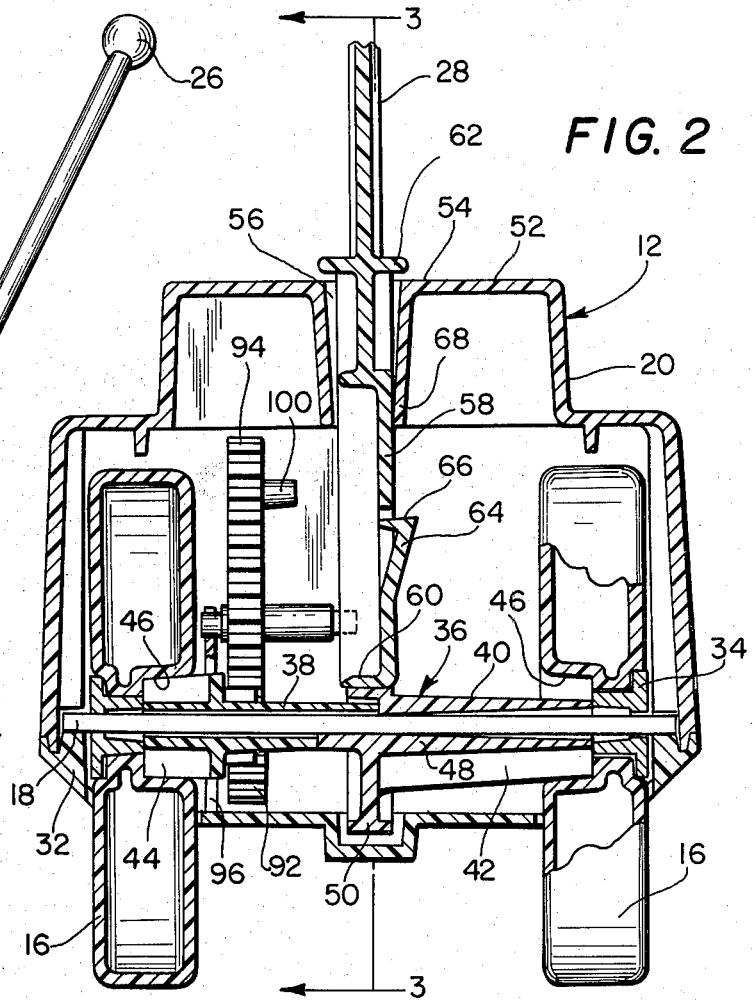
FIG. 2 is a transverse sectional view taken along the line 2—2 of FIG. 1.
Figure 3:
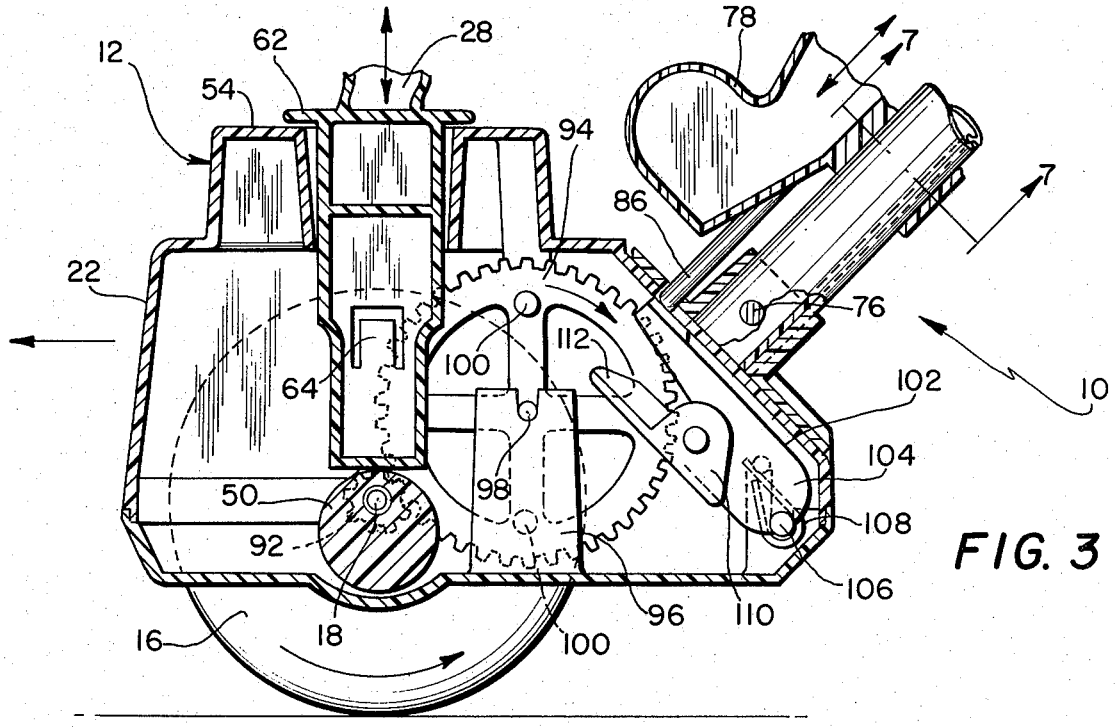
FIG. 3 is a sectional view taken along the line 3—3 of FIG. 2.

The upper panel 20 of the housing 12 includes an upstanding boss 52 having an upper surface 54. A slot 56 is formed in such upper surface 54 so to accept the blade-like lower portion 58 of the first action element 28. The blade 58 forms a cam follower and terminates at its lower end in a footed element 60 for such purpose. The outer surface of the foot 60 is adapted to contact the outer surface of the cam 50, and, accordingly, as the cam body 48 rotates, it will cause the action element 28 to ride up and down within the confines of the slot 58. In the lower position of the first action element 28 as shown in FIGS. 2 and 3, a laterally extending flange 62 is adapted to either contact or make approximate contact with the upper surface 54 proximal the slot 56 so as to form a lower stop with respect to the downward travel that is permitted the first action element 28. In addition, the blade 58 is provided with a laterally extending tang or projection 64 having an upper surface 66. Such tang 64 in effect forms an upper stop and is adapted to contact the lower edge of downwardly depending walls 68 which define the slot 56. It may thus be apparent that the rotation of the wheels 16 causes the first action element 28 to be forced upwardly and then permits such to fall as by gravity while at all times being contacted by the cam 50 and thus imparting a continuous up and down movement to the action element 28 during both forward and rearward movement of the device 10.

Figure 4:
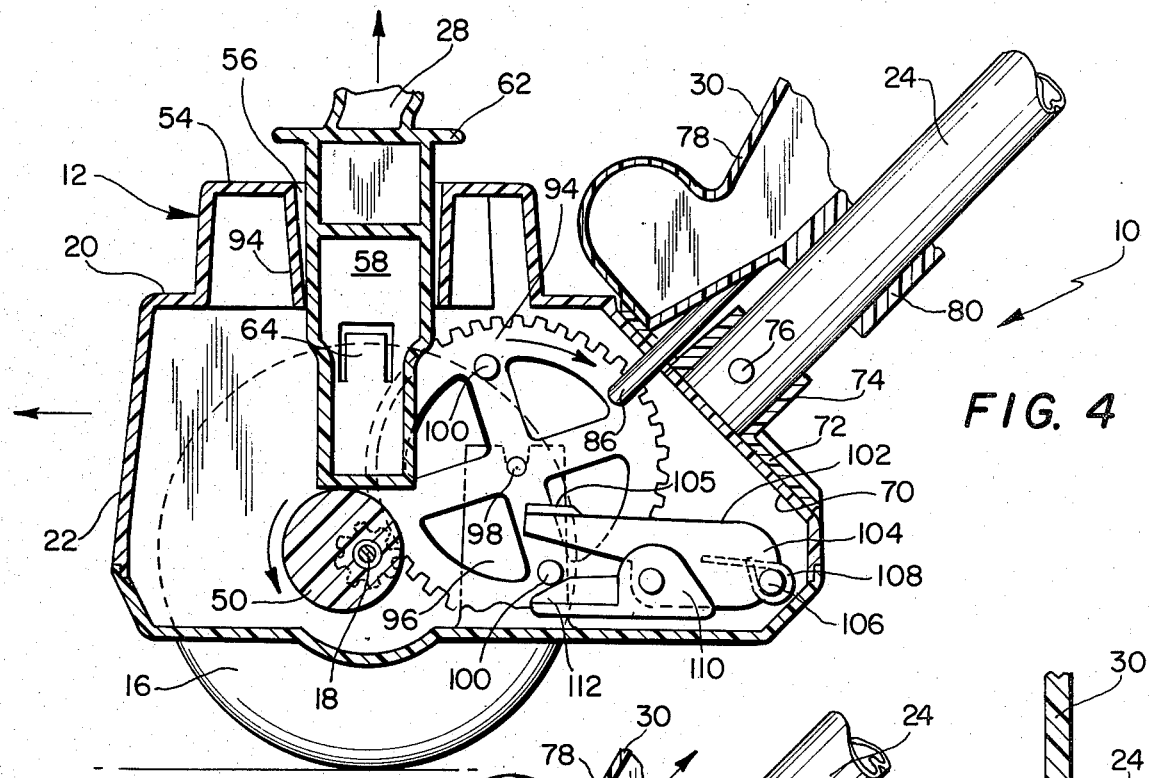
FIG. 4 is a sectional view similar to FIG. 3 but showing the device in a different operational position.

Turning again to FIGS. 3, 4 and 5 of the drawings, the structure of the second action element 30 and the manner in which such operates will be apparent. In this regard, a rear panel 70 of the housing 12 is provided with a re-enforcing plate 72 having an upstanding tubular collar 74. One end of the push rod 24 is adapted for receipt in the collar 74 and fixedly attached thereto as by a pin 76. As previously indicated, the second action element 30 may be of any desired configuration and includes a body 78 from which a tubular collar 80 depends. The collar 80 includes an upstanding flange 82 which is adapted for aligned receipt in a longitudinally oriented groove 84 formed along the lower surface of the push rod 24. In this way, the second action element 30 is free to travel up and down with respect to the push rod 24 as shown by the arrows in FIG. 3 but is restrained from rotational movement with respect thereto. The rear portion of the body 78 includes a rearwardly downwardly extending pin 86 which in turn is adapted to extend through an opening 88 in the housing 12 such that the terminal end of the pin 86 extends into the interior of the housing in its rest or non-actuated lower position as shown in FIG. 4.

The pinion portion 38 of the cam and pinion assembly 36 includes a pinion gear 92 fixedly attached thereto.

A second or main gear 94 is supported on a pair of laterally spaced trunions 96 by means of an axle 98 extending to lateral opposite sides thereof. Gear 94 includes a pair of diametrically opposed pins 100 which inwardly laterally extend from one side thereof and are mounted in the main body of the gear, that is, radially offset from the central axis thereof. Accordingly, as the wheels 16 rotate, such rotation causes the pinion and main gears 92 and 94 respectively to also rotate such that the pins 100 may alternatively come in contact with and release a spring actuation assembly 102.

Figure 5:
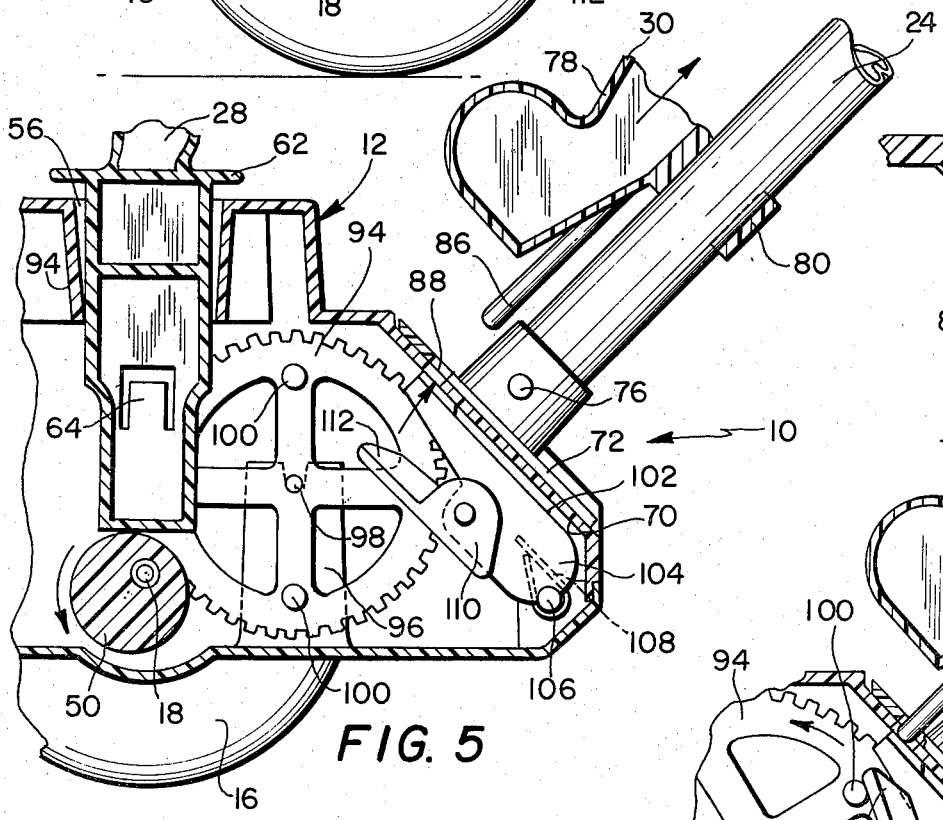
FIG. 5 is a partial sectional view similar to FIG. 3.
Figure 7:
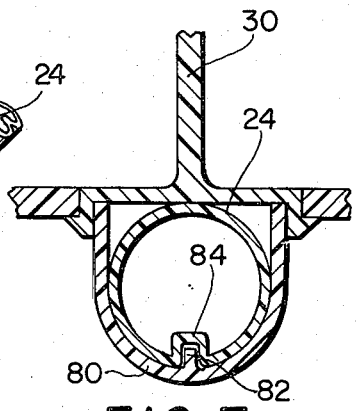
FIG. 7 is a sectional view taken along the line 7—7 of FIG. 3.

Such spring actuation assembly 102 includes an enlongated body member 104 which is pivotally supported at one end thereof by means of a pin 106. A spring 108 normally biases the elongated body 104 in the position as shown in FIG. 3 wherein the upper terminal end of the body 104 forms a hammer 105 capable of contact with the terminal end of the pin 86 as will hereinafter be more fully explained. An actuation lever 110 is pivotally mounted on the body member 104 intermediate the extent thereof as at 111 and terminates in an upwardly extending finger or trigger portion 112. The lever 110 is freely pivotable upwardly towards the hammer end of the body but is normally disposed in a position as shown in FIGS. 3 through 5 in a location distal from the hammer 105 wherein the lower portions of the lever 110 and the body 104 contact each other so as to move as a unit. This contact may be accomplished by providing an outwardly extendingly flange (not shown) or other element on the lever so as to engage the lower edge of the body 104. In such position, rotation of the gear 94 positions one of the pins 100 in contact with the finger 112 such that further rotation along a portion of the circular travel path of the gear 94 forces the actuation lever 102 from the position shown in FIG. 3 to a loaded or cocked position shown in FIG. 4.

Continued rotational movement of the gear 94 caused by the forward pushing of the toy 10 in the direction of the arrow (see FIG. 4) forces the pin 100 to slip past the finger 112 and enables the actuation assembly 102 to be released and be forcibly driven to its upper position around its pivot pin 106. When such happens, the hammer 105 strikes the pin 86 so as to cause the second action element 30 to be abruptly propelled upwardly along the push rod 24. After reaching the upper extent of its travel, the second action element 30 falls downwardly into its rest position as shown in FIG. 4 by gravity. Accordingly, the movement of the second action element 30 is intermittent and dependent on the number and position of the pins 100. Normally, however, two diametrically opposed pins have been found to produce satisfactory results since such drives the second action element 30 up the push rod 24 twice during a complete revolution of the gear 94.

Figure 6:
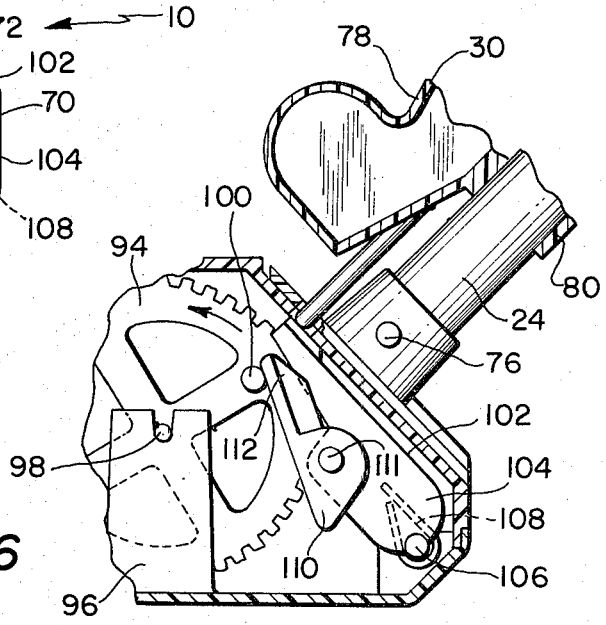
FIG. 6 is a partial view similar to FIG. 3 but showing in particular the operation of the device when pulled rearwardly.

From the above it is apparent that both the first and second action elements 28 and 30 respectively are operational during the forward movement of the toy. However, when the toy is pulled rearwardly or to the right as shown in the drawing, the operation of the actuation assembly 102 is such that only the first element 28 is driven. Turning now to FIG. 6 of the drawings, it will be apparent that the free upward pivotal motion of the lever 110 with respect to the actuation body 104 permits such operation. Accordingly, when the toy is pulled, causing rotation of the gear 94 in the opposite direction or as shown by the arrow in FIG. 6, the pin 100 contacts the lever 110 from the underside such that the lever is merely pivoted upwardly and out of the way. When gear rotation is continued, the pin moves out of contact with the lever 110 and merely enables it to return by gravity to its rest position and in this manner accomplishes the above mentioned operation wherein the first action element 28 continues to move pursuant to both forward and rearward motion of the toy but in which only forward movement of the toy actuates the second action element 30.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A push toy comprising a housing, a generally upright push rod connected thereto, said housing including an axle for supporting wheel means in turn adapted to rotate in contact with a supporting surface as said toy is moved thereacross by said push rod, a first action element supported by said housing and adapted for reciprocal movement with respect thereto, a second action element supported by said push rod and adapted for reciprocal movement with respect thereto, first activation means associated with said axle for generally continuous moving said first element during movement of said toy and second activation means associated with said axle for intermittently moving said second element during movement of said toy, said second element slidably mounted on said push rod and including a pin downwardly extending therefrom, said second activation means including spring means having a hammer and adapted for loading by rotation of said wheel means during a portion of a single revolution thereof and release during another portion thereof such that said hammer strikes said pin upon its release so as to abruptly propel said second element up said push rod whereupon it falls back to its original position by gravity.

2. A push toy comprising a housing, a generally upright push rod connected thereto, said housing including an axle for supporting wheel means in turn adapted to rotate in contact with a supporting surface as said toy is moved thereacross by said push rod, a first action element supported by said housing and adapted for reciprocal movement with respect thereto, a second action element supported by said push rod and adapted for reciprocal movement with respect thereto, first activation means associated with said axle for generally continuous moving said first element during movement of said toy and second activation means associated with said axle for intermittently moving said second element upon rotation of said wheel means in one direction only, said second activation means including a gear supported by said housing and adapted for rotation along with said wheel means and spring means supported from said housing and positioned laterally offset from the plane defined by the rotation of said gear, said spring means including a hammer, said gear including at least one laterally projecting pin adapted to contact and progressively load said spring means during a portion of a single gear revolution and thereafter suddenly release said spring means such that the hammer thereof strikes said second element so as to abruptly propel such upwardly along said push rod.

3. A push toy comprising a housing, a generally upright push rod connected thereto, said housing including an axle for supporting wheel means in turn adapted to rotate in contact with a supporting surface as said toy is moved thereacross by said push rod, a first action element supported by said housing and adapted for reciprocal movement with respect thereto, a second action element supported by said push rod and adapted for reciprocal movement with respect thereto, first activation means associated with said axle for generally continuous moving said first element during movement of said toy and second activation means associated with said axle for intermittently moving said second element during movement of said toy, said second element slidably mounted on said push rod and including a pin downwardly extending therefrom, said second activation means including spring means having a hammer and adapted for loading by rotation of said wheel means during a portion of a single revolution thereof and release during another portion thereof such that said hammer strikes said pin upon its release so as to abruptly propel said second element up said push rod whereupon it falls back to its original position by gravity, said spring means mounted in said housing, said second element non-rotationally mounted on said push rod such that said pin projects through a rear wall of said housing and is thus oriented for contact by said hammer.

4. A push toy comprising a housing, a generally upright push rod connected thereto, said housing including an axle for supporting wheel means in turn adapted to rotate in contact with a supporting surface as said toy is moved thereacross by said push rod, a first action element supported by said housing and adapted for reciprocal movement with respect thereto, a second action element supported by said push rod and adapted for reciprocal movement with respect thereto, first activation means associated with said axle for generally continuous moving said first element during movement of said toy and second activation means associated with said axle for intermittently moving said second element upon rotation of said wheel means in one direction only, said second activation means including a gear supported by said housing and adapted for rotation along with said wheel means and spring means supported from said housing and positioned laterally offset from the plane defined by the rotation of said gear, said spring means including a hammer, said gear including at least one laterally projecting pin adapted to contact and progressively load said spring means during a portion of a single gear revolution and thereafter suddenly release said spring means such that the hammer thereof strikes said second element so as to abruptly propel such upwardly along said push rod, said spring means including an elongated body pivotally mounted on said housing, said hammer formed from an upper portion of said body, said body being spring biased towards a first position, a lever mounted on said body for free pivotal movement in a direction towards said body and for movement with said body in the opposite direction, said gear pin adapted to contact said lever upon rotation thereof so as to pivot said body in an opposite second direction against the action of said spring whereupon continued rotation of said gear in one direction causes said gear pin to disengage said lever and thus cause said body to be abruptly forced to its first position by said body spring, said lever being freely movable to a rest position by said gear pin when said gear is rotated in its opposite direction such that the second action element is not activated when the gear is rotated in its opposite direction as when the toy is pulled rather than pushed.

5. The push toy of claim 4, said axle including a pinion in turn meshed with said gear.

6. The push toy of claim 4, said gear including a pair of diametrically opposed pins.

* * * * *